US008047547B2

(12) United States Patent
Browne

(10) Patent No.: US 8,047,547 B2
(45) Date of Patent: Nov. 1, 2011

(54) AFRICAN HISTORY CARD GAME

(76) Inventor: Brian G. Browne, Miami Gardens, FL (US)

( * ) Notice: Subject to any disclaimer, the term of this patent is extended or adjusted under 35 U.S.C. 154(b) by 0 days.

(21) Appl. No.: 12/461,429

(22) Filed: Aug. 11, 2009

(65) Prior Publication Data

US 2010/0038853 A1 Feb. 18, 2010

Related U.S. Application Data

(60) Provisional application No. 61/136,158, filed on Aug. 14, 2008.

(51) Int. Cl.
*A63F 9/18* (2006.01)

(52) U.S. Cl. ..... 273/429; 273/272; 273/299

(58) Field of Classification Search ..... 273/272, 273/296, 299, 302, 429–432
See application file for complete search history.

(56) References Cited

U.S. PATENT DOCUMENTS

| | | | | |
|---|---|---|---|---|
| 1,138,534 | A | 5/1915 | Brister | |
| 2,138,524 | A | 11/1938 | Harkins | |
| 4,558,865 | A | 12/1985 | Isgar | |
| 4,635,939 | A | 1/1987 | Makow | |
| 4,732,393 | A | 3/1988 | Rita | |
| 5,454,569 | A | 10/1995 | Walker | |
| 5,580,252 | A * | 12/1996 | McCrady | 434/128 |
| 5,690,336 | A | 11/1997 | Oliver | |
| 5,836,587 | A | 11/1998 | Druce et al. | |
| 5,906,491 | A * | 5/1999 | Berman | 434/150 |
| 6,045,131 | A | 4/2000 | Adams et al. | |
| 6,139,016 | A | 10/2000 | Plato | |
| 6,322,074 | B1 * | 11/2001 | Forrest et al. | 273/272 |
| 6,386,880 | B2 * | 5/2002 | Bryant | 434/188 |
| 6,409,512 | B1 | 6/2002 | Catto | |
| 6,457,716 | B1 | 10/2002 | Johnson Prillerman | |
| 7,055,823 | B2 | 6/2006 | Denkewicz, Jr. | |
| 2002/0015935 | A1 * | 2/2002 | Bryant | 434/188 |
| 2003/0137108 | A1 | 7/2003 | Mathews | |
| 2004/0160004 | A1 * | 8/2004 | Levine | 273/254 |
| 2006/0012123 | A1 | 1/2006 | Cavanaugh et al. | |
| 2006/0154225 | A1 * | 7/2006 | Kim | 434/322 |
| 2008/0054571 | A1 | 3/2008 | Davidzon et al. | |
| 2008/0224396 | A1 * | 9/2008 | Cocis et al. | 273/157 R |
| 2009/0121474 | A1 * | 5/2009 | Hughes | 283/100 |

FOREIGN PATENT DOCUMENTS

GB 2230962 7/1990

OTHER PUBLICATIONS

Website, http://www.educationallearninggames.com/world-wise-african-card-game.asp, two pages printed from the internet on Jun. 30, 1988.

* cited by examiner

*Primary Examiner* — William Pierce
(74) *Attorney, Agent, or Firm* — Richard C. Litman

(57) ABSTRACT

The African history card game includes a deck of educational cards. Each card has a front face with a fact, picture, question, and series of multiple choice answers each relating to a common theme, and a rear face having an alphabetic matrix of columns and rows concealing the correct answer. Point values based on the difficulty of the question on the particular card are provided on each card. Each card has a particular theme related to African history, e.g., geography, prominent individuals, history, inventions, science, engineering, sports, religion, culture, civil rights, agriculture, language, and music. The game may be adapted to other themes and subject areas, as desired. The object of the game is to determine the correct response of the choices on the front of the card, then find and point out this response in the rows, columns, and/or diagonals of the matrix on the back of the card.

4 Claims, 5 Drawing Sheets

AFRICAN HISTORY CARD GAME

CROSS-REFERENCE TO RELATED APPLICATION

This application claims the benefit of U.S. Provisional Patent Application Ser. No. 61/136,158, filed Aug. 14, 2008.

BACKGROUND OF THE INVENTION

1. Field of the Invention

The present invention relates generally to educational games. More particularly, the present invention comprises a game having a series of cards each containing a question and a series of answer choices, with the correct answer concealed in an alphabetic matrix on the reverse side of the card.

2. Description of the Related Art

Many African-Americans, both young and old, do not have a basic knowledge of African history. This lack of knowledge can cause problems in a person's ability to effectively function in today's society. There are many instances when basic knowledge of African history is needed.

Recent studies have shown a large percentage of people in this country are ignorant of world geography and cannot identify countries on a map. Other studies have shown that people do not know elected officials, both here and abroad; cultural events; or even basic historical facts. Evidently, the teaching methods and apparatus available now are not serving the function of teaching this basic knowledge. There are card games with printed information on the cards, but the games do not appear to be very effective in helping people retain knowledge about geography coupled with basic African history.

Accordingly, there is a need for an enjoyable educational card game that helps people retain basic knowledge about African history by providing facts and pictorial stimulation reiterated with a question having multiple choice answers, and including the answer hidden on the back of the card in a letter grid or matrix. Such educational card games can begin at an entry level and continue to much higher and more difficult levels, enticing people to play. Thus, an African history card game solving the aforementioned problems is desired.

SUMMARY OF THE INVENTION

The African history card game includes a deck of educational cards. Each card of the deck has a front face with a fact, picture, and question all relating to a common theme, and a plurality of answers relating to the question, with only one of the answers being correct. Each card also has a rear face concealing the correct one of the answers.

A point value is printed on both the front face and rear face of each card of the deck, the point value being based on the difficulty of the question on the particular card. Each card has a single theme related to African history. The areas the themes may cover include geography, prominent individuals, history, inventions, science, engineering, sports, religion, culture, civil rights, agriculture, language, and music, and may extend to other subject areas as well.

Each card also has a colorful grid on the rear face. The colors are in a rectangular shape of a hanging flag with an outline of the African continent displayed in the middle of the grid. The grid is formed of columns and rows defining cells each having a letter of the alphabet therein, with the letters appearing to be randomly selected from the alphabet. A correct answer to the theme question displayed on the front of the card is hidden, but unscrambled, in a row, column, or diagonal of the grid or matrix, and may appear either forwards or backwards. The correct answer may comprise two or more words, with the words being separated in different rows, columns, and/or diagonals of the grid or matrix.

The game is played by initially selecting a judge from the participants and dealing a single card, front face down, to each player. The number of players is limited only by the number of cards provided in the deck. Players are not permitted to view the front side of their cards until the judge permits such viewing. Points are deducted from the cumulative score of any player who views the front face (question and answer side) of their card before permission is issued by the judge. Once the judge has signaled the players to begin, they may view the first side of their cards and attempt to determine the correct answer from the plurality of answers to the question. The players then seek this answer in the alphabetic grid or matrix on the opposite second side of the card.

The first player to indicate that he or she has discovered the correct answer, signals such to the other players and the game is stopped at that point. Other players return their cards to the judge or to a common location for redistribution for the next round of play. The judge determines whether the first player to indicate that he or she has the correct answer is actually correct. If so, that player is awarded points according to the point value on their card. If not, a number of points are deducted from that player's cumulative score, in accordance with the point value on the card.

The game continues with the cards being redistributed or redealt to the players for each round of play, with each player again attempting to answer correctly the question on their card in accordance with the description of play above. The winner of the game is the player who first reaches a predetermined score, e.g., four hundred points. Alternatively, the game may be played to a time limit, with the player having the highest score at the end of the predetermined time or time limit being the winner.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
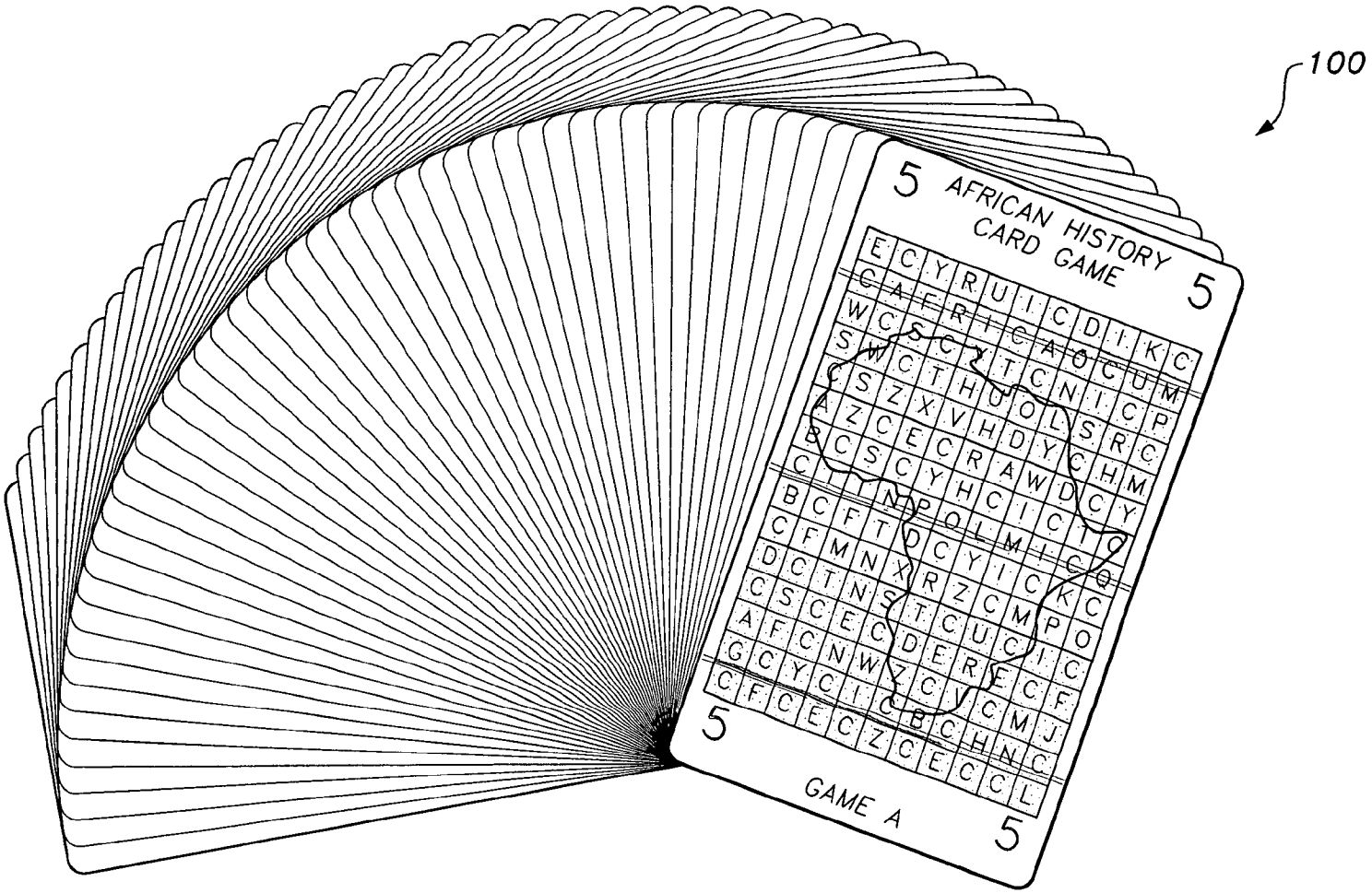
FIG. 1 is a top plan view of the plurality of cards used in the African history card game according to the present invention, with the second face of one card exposed to illustrate features thereof.

The present invention is an African history card game, with an exemplary deck of cards 100 illustrated in FIG. 1. The game cards of the deck 100 are configured to provide players with knowledge of the achievements and contributions of Africans, at home and abroad, to human civilization, as well as to provide some rudimentary geographical and cultural information. The game is an exciting learning tool that encourages interaction and discussion among the players of all ages and backgrounds. The game is a learning tool that can be used in classrooms, libraries, at social events, while traveling or even mediating. Accordingly, the game is a fun card game that allows several players to participate at the same time or the cards of the deck 100 can be utilized individually because of the educational value. Thus, there is an educational part to the game as well as a competition level that will be described with reference to the other drawings.

There can be over fifty levels of the African history card game, with each level having a separate and distinct deck of cards. The games may be designated as "A" through "Z" and continue "AA" through "ZZ"" and so forth. Once players have mastered one particular game, they can move on to a different or more advanced game, as the players further their knowledge of African history, geography, and culture. The card deck 100 of the African history game provides factual information in a historical perspective. The player can and will often discuss the implications of the facts stated on each of the cards. The rules are simple and stated as follows:

TABLE I

| BASIC RULES OF PLAY | |
|---|---|
| Rule 1: | There are fifty cards per pack. (More or fewer cards may be provided in each pack or deck, as desired.) |
| Rule 2: | A maximum number of players equal to the number of cards in a deck may play, e.g., up to fifty players can be involved in a game using a fifty card deck. |
| Rule 3: | Cards are distinguished as three groups, with each group having questions differing in difficulty from the other groups. The groups are valued correspondingly, e.g., having values of five, ten, and twenty points per card in each of the groups. |
| Rule 4: | There must be one official judge. |
| Rule 5: | The judge determines who was first to signal that they identified the correct answer, in each round of play. |
| Rule 6: | The judge keeps score. |
| Rule 7: | The order of play is determined. One means of determining the order of play is for the judge to deal the cards randomly to the players, with the player receiving the first card dealt that has a maximum value, becoming the dealer for the round. The deal may progress to the left, right, or in some other manner as mutually agreed upon. |
| Rule 8: | The dealer deals each player one card, with the second or rear face (alphabetic matrix face) upward. |
| Rule 9: | The players are not to see the question on the card until the judge says to start. |
| Rule 10: | When the judge signals start, the players turn over their cards to view the first face with the question and series of answer choices, and attempt to answer the question. Players then attempt to locate the answer in the grid or matrix on the second side. |
| Rule 11: | The player who is the first to identify the answer on the word puzzle matrix immediately stops the game. |
| Rule 12: | Once the player signals stop, other players turn in their cards to the judge. |
| Rule 13: | The judge verifies that the first identifying player identified the correct answer and awards that player the points listed on the player's card. |

TABLE I-continued

| BASIC RULES OF PLAY | |
|---|---|
| Rule 14: | If the first identifying player fails to identify the correct answer, the point total is deducted from that player's score. |
| Rule 15: | If a player is caught looking at the question (first side or face of the card) before the judge signals start, the point total of the card is deducted from that player's score. |
| Rule 16: | The winner of the game is the one who reaches the total agreed upon by all the players at the start of the game, or alternatively the player leading at the end of a predetermined period of time. |
| Rule 17: | The game may be played to four hundred points, or other point total as decided upon by the players and judge. In the event of a tie, another round can be played to determine the winner. |

Accordingly, as will be discussed with reference to the remaining figures, the game includes a deck 100 of fifty (or more or fewer) factual cards. Each card in the deck 100 has a fact and picture followed by an educational question, and a plurality of answer choices, with only one of the answers being correct. The fact, picture, question, and answers on the first face of each card all have a common, related theme. Each card also has a point value based on a level of difficulty of the question on the particular card. Players must attempt to determine the answer to the question on the first or front face, then flip the card over to view the obverse face and find the answer on a letter grid or matrix that hides the correct answer.

Figures 2A, 2B:
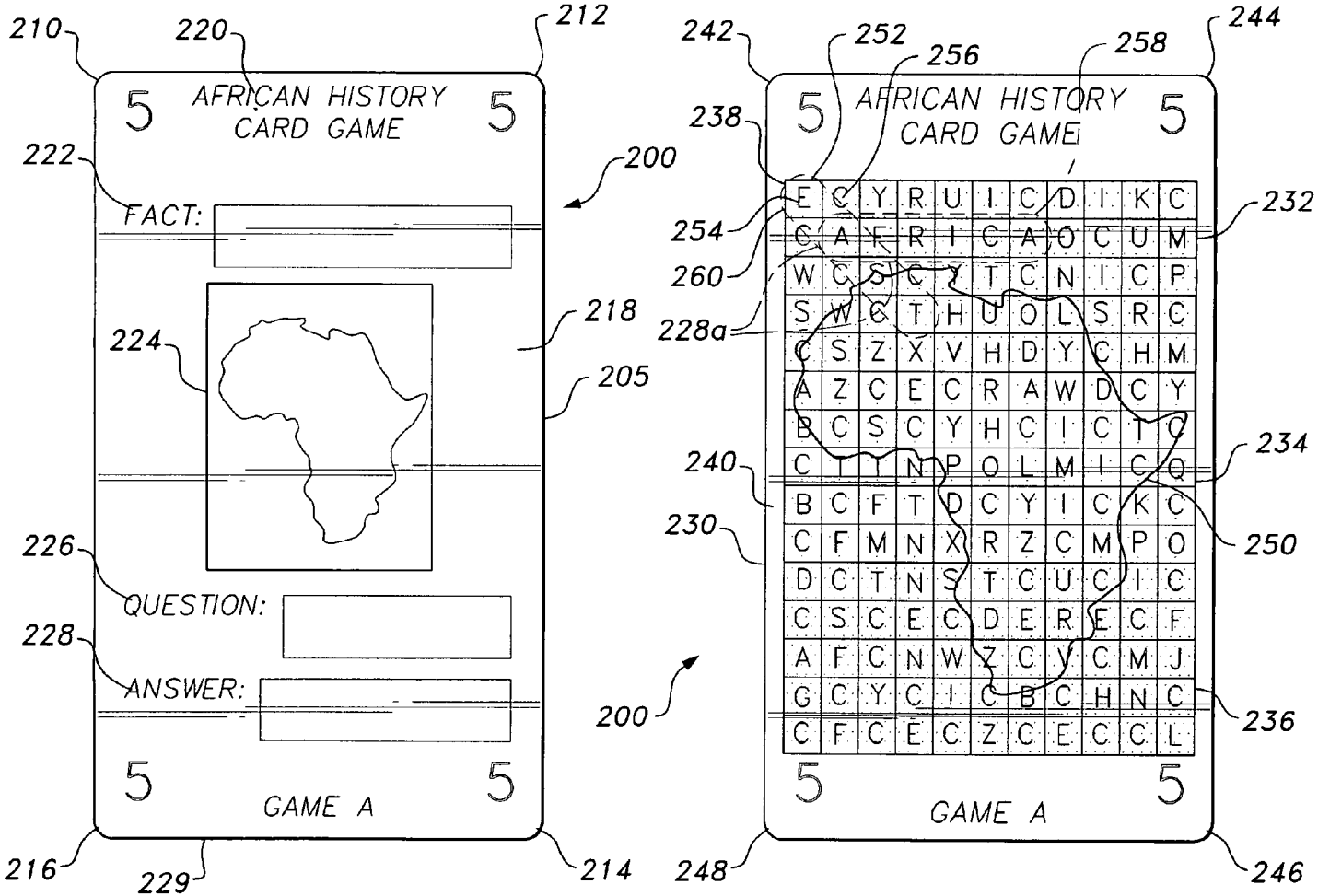
FIG. 2A is a front view of an exemplary card with a numerical value of five points from the African history card game according to the present invention.
FIG. 2B is a rear view of the card of FIG. 2A, showing further features thereof.

With respect to FIG. 2A, a card 200 having a front face 205 with a numerical value of five points is shown. The African history card deck 100 includes a plurality (e.g., twenty-eight, or more or fewer) of five point value cards 200 with the points indicated in each of the four corners 210, 212, 214, and 216. The card 200 has a white (or alternatively, some other color) background 218, and all the information, both alphabetic and numeric, are displayed in a contrasting color on the front face 205 to facilitate reading the card 200.

At the top 220 of the card 200 is the title of the card game, i.e., African History Card Game. Next is a fact 222 that is the theme of the card 200, e.g., "African runners have dominated long distance events in the Olympics." On this card 200, the theme is geography. On some of the other twenty-eight five-point cards, the themes cover prominent individuals, history, inventions, science, sports, religion, culture, civil rights, agriculture, language, and music.

A picture 224, shown below the fact 222, reiterates the theme of the card 200. Below the picture 224 is a question 226. The question 226 is directly focused on the theme of the card 200. On this card 200, the theme is geography so the question 226 could be "Which area in Africa is recognized for producing the best long distance runners?" Below the question 226, is a series of answers 228 including the single correct answer 228*a* (shown on the back face 230 of the card 200, in FIG. 2B). Exemplary answers for the above question may be:

| | |
|---|---|
| 1. North Africa | 2. South Africa |
| 3. East Africa | 4. West Africa |

At the bottom 229 of the card is a rating system of the difficulty of the particular card game. In this case, the game is rated with an "A." As has been discussed before, there may be over fifty levels of the African history card game. The games are labeled "A" through "Z" and continue "AA" through "ZZ"" and so forth, with the educational difficulty increasing with every increased rating.

With reference now to FIG. 2B, a rear view or rear face 230 of the card 200 is shown. The rear face 230 contains three main colors: red 232, yellow 234, and green 236, forming a rectangular or hanging flag member 238 (which also forms a grid or matrix of rows and columns of alphabetic characters) with the red color 232 on top. These three colors make up the colors now found in the national flags of many African nations. The colors are surrounded with a white (or other color, as desired) border 240 so as to make the reading of the back of the card easy and less of strain on a player's eyes. Around the border 240 are four corners 242, 244, 246, and 248 with the number five prominently displayed in each of the corners 242, 244, 246, and 248 to indicate the point value of the card 200. Also, the indicia both alphabetic and numeric outside the hanging flag or alphabetic grid or matrix 238 may be printed in red (or other contrasting color) on this rear face 230 to facilitate the reading of the card 200, and to keep the color coordination. Other colors may be used as desired. Outlined on the rear face 230 throughout the colors red 232, yellow 234, and green 236 is an outline 250 of the continent of Africa. The outline 250 is in black. Thus, all four colors of the Pan-Africa nations are represented on the back of the cards for the card deck 100.

The rectangular or hanging flag 238 includes a letter grid with columns 252 and rows 254. There are preferably eleven columns and sixteen rows forming the rectangular black letter grid 238 over the colors red 232, yellow 234, and green 236, although more or fewer rows and columns may be used as desired. Most of the cells or squares 256 in the grid 238 include a letter from a random selection of letters A to Z, with some letters being repeated to scramble the letters throughout the grid 238. The scrambling makes the grid 238 appear to be made up of random letters. However, the correct one of the answers 228 for the question 226 on the front face 205 of the card 200 can be found unscrambled in the grid 238.

On the back 230 of this card 200, the correct answer **228*a* to the question 226 is found in two separate areas of the alphabetic grid or matrix 238, as the answer 228 comprises two words. The first word, "EAST," is read from the upper left corner of the matrix 238, diagonally downward and to the right, as indicated by the broken line enclosure 260. The second word, "AFRICA," is found across the second row from the top, beginning with the second letter in that row (the "A" in the word "EAST" comprising the first word of the answer 228*a*), as indicated by the broken line enclosure 258. In this example, the two words overlap and share a common letter, but this is not a requirement. Oftentimes the correct answer is a single word, but multiple words may be placed anywhere on the matrix or flag 238 as desired, either separate from one another or overlapping. Of course, an answer can be in a column, row, in a diagonal direction, or even any combination, and may read forwards or backwards. However, while the correct answer 228*a* is hidden in the letter grid 238, it is not scrambled, and it should be noted that only one correct answer is on the rear face 230 of card 200**.

Figure 3B:
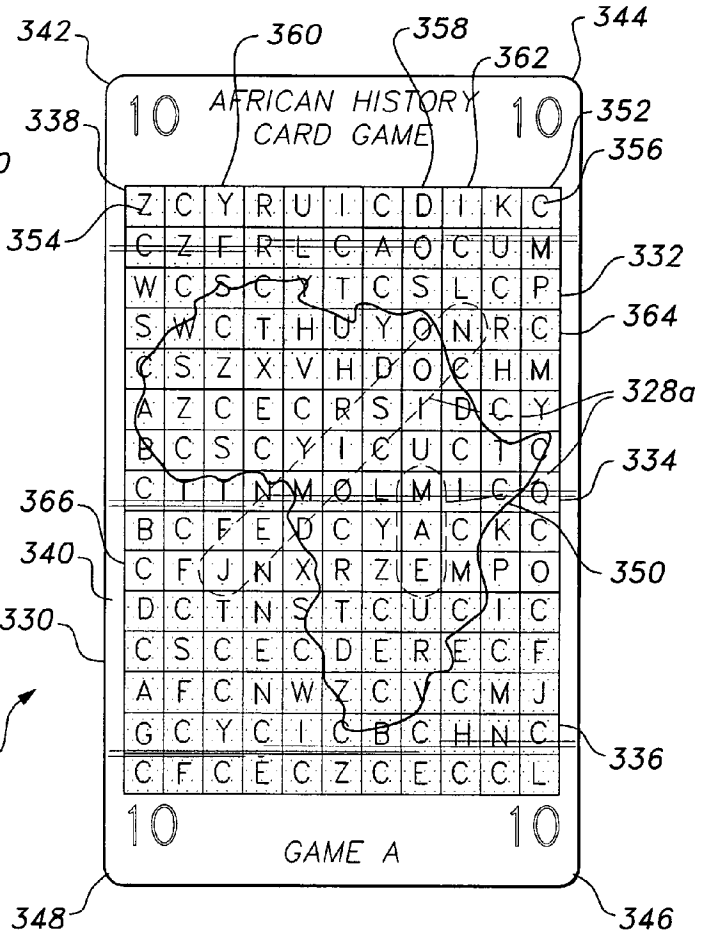
FIG. 3B is a rear view of the card of FIG. 3A, showing further features thereof.
Figure 3A:
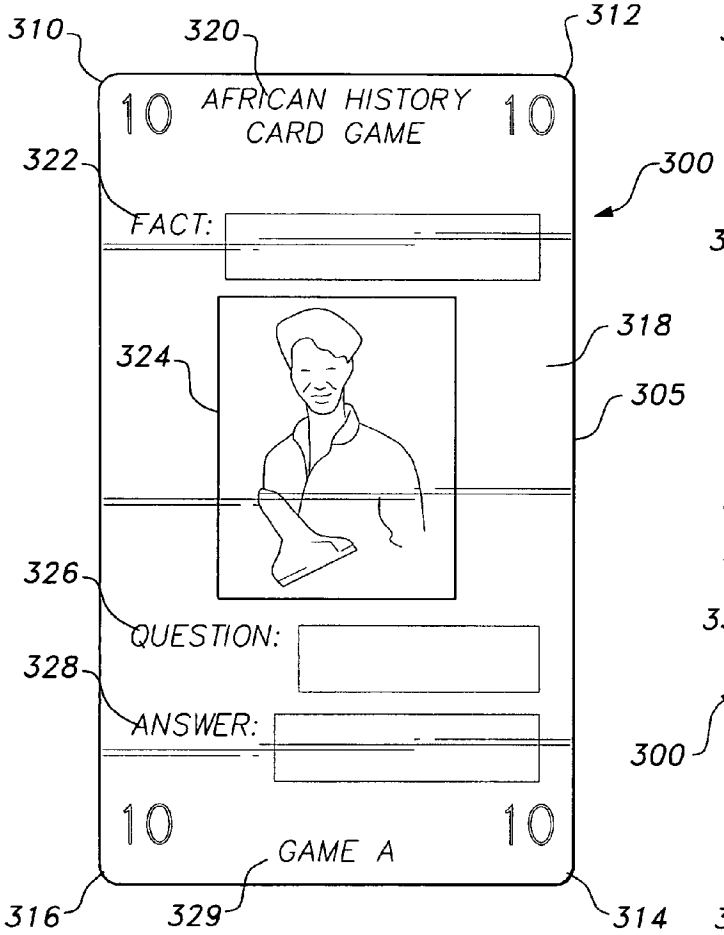
FIG. 3A is a front view of an exemplary card with a numerical value of ten points from the African history card game according to the present invention.

With respect to FIG. 3A, a card 300 having a front face 305 with a numerical value of ten points is shown. The African history card deck 100 includes a plurality (e.g., eighteen, or more or fewer) of ten point value cards 300 with the points indicated in each of the four corners 310, 312, 314, and 316. The card 300 has a white (or alternatively, some other color) background 318, and all the information, both alphabetic and numeric, are displayed in a contrasting color on the front face 305 to facilitate reading the card 300.

At the top 320 of the card 300 is the title of the card game, i.e., African History Card Game. Next is a fact 322 that is the theme of the card 300, e.g., On this card 300, the theme is prominent people, or more specifically, African-Americans who have made a contribution in the fields of science and engineering. On some of the other ten point cards 300, the themes cover prominent individuals, history, inventions, science, sports, religion, culture, civil rights, agriculture, language, and music.

A picture 324, shown below the fact 322, reiterates the theme of the card 300. Below the picture 324 is a question 326. The question 326 is directly focused on the theme of the card 300. On this card 300, the theme is African-Americans that have made a contribution in the fields of science and engineering, so the question 326 is "who was the first African female astronaut?" Below the question 326, is a series of answers 328 including the single correct answer **328*a* (shown on the back face 330 of the card 300**, in FIG. 3B). Exemplary answers for the above question may be:

| | |
|---|---|
| 1. Mae Jemison | 2. Angela Davis |
| 3. Althea Hendrinks | 4. Mavis John |

At the bottom 329 of the card is a rating system of the difficulty of the particular card game. In this case, the game is rated with an "A." As has been discussed before, there may be over fifty levels of the African history card game. The games are labeled "A" through "Z" and continue "AA" through "ZZ"" and so forth, with the educational difficulty increasing with every increased rating.

With reference now to FIG. 3B, a rear view or rear face 330 of the card 300 is shown. The rear face 330 contains three main colors: red 332, yellow 334, and green 336, forming a rectangular or hanging flag member 338 (which also forms a grid or matrix of rows and columns of alphabetic characters) with the red color 332 on top. These three colors make up the colors now found in the national flags of many African nations. The colors are surrounded with a white (or other color, as desired) border 340 so as to make the reading of the back of the card easy and less of strain on a player's eyes. Around the border 340 are four corners 342, 344, 346, and 348 with the number ten prominently displayed in each of the corners 342, 344, 346, and 348 to indicate the point value of the card 300. Also, the indicia both alphabetic and numeric outside the hanging flag or alphabetic grid or matrix 338 may be printed in red (or other contrasting color) on this rear face 330 to facilitate the reading of the card 300, and to keep the color coordination. Other colors may be used as desired. Outlined on the rear face 330 throughout the colors red 332, yellow 334, and green 336 is an outline 350 of the continent of Africa. The outline 350 is in black. Thus, all four colors of the Pan-Africa nations are represented on the back of the cards for the card deck 100.

The rectangular or hanging flag 338 includes a letter grid with columns 352 and rows 354. There are preferably eleven columns and sixteen rows forming the rectangular black letter grid 338 over the colors red 332, yellow 334, and green 336, although more or fewer rows and columns may be used as desired. Most of the cells or squares 356 in the grid 338 include a letter from a random selection of letters A to Z, with some letters being repeated to scramble the letters throughout the grid 338. The scrambling makes the grid 338 appear to be made up of random letters. However, the correct one of the answers 328 for the question 326 on the front face 305 of the card 300 can be found unscrambled in the grid 338.

On the rear face 330 of this card 300, the correct answer 328*a* to the question 326 is found vertically in column eight ("MAE"), indicated specifically by the reference numeral 358, and in an ascending left-to-right diagonal in columns three through nine, indicated respectively by reference numerals 360 and 362, and rows four through ten indicated respectively by reference numerals 364 and 366 ("JEMISON"). Of course, an answer can be in a column, row, or even in a diagonal direction, as on this card 300 where the answer comprises two words or names in a column and in a diagonal direction. However, while the correct answer 328*a* is hidden in the letter grid 338, it is unscrambled, and it should be noted that only one correct answer 328*a* is on the rear face 330 of card 300.

Figure 4B:
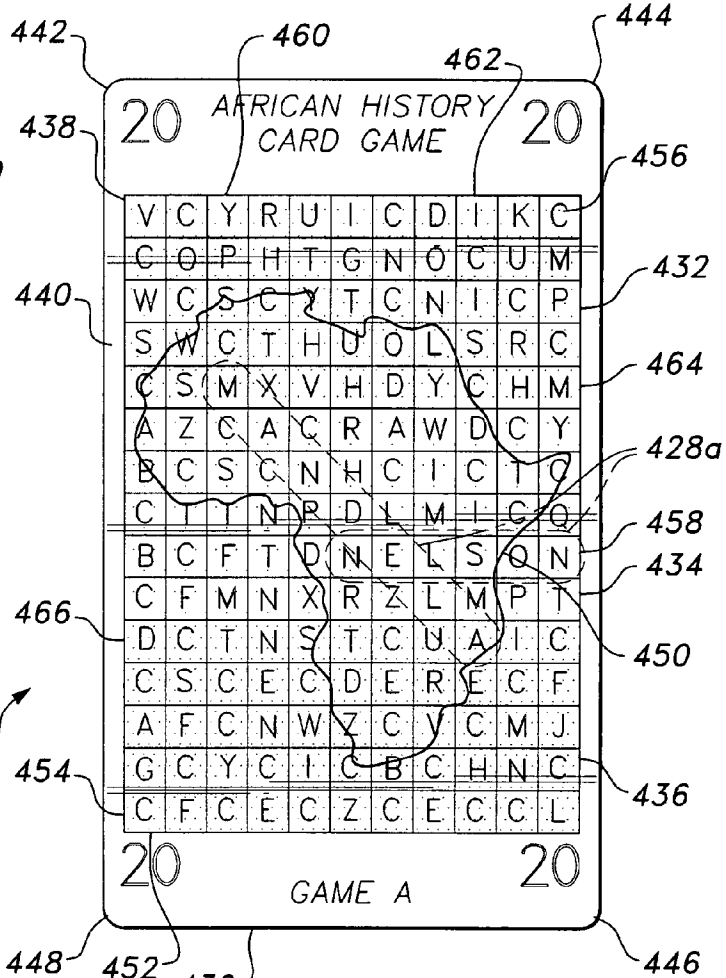
FIG. 4B is a rear view of the card of FIG. 4A, showing further features thereof.
Figure 4A:
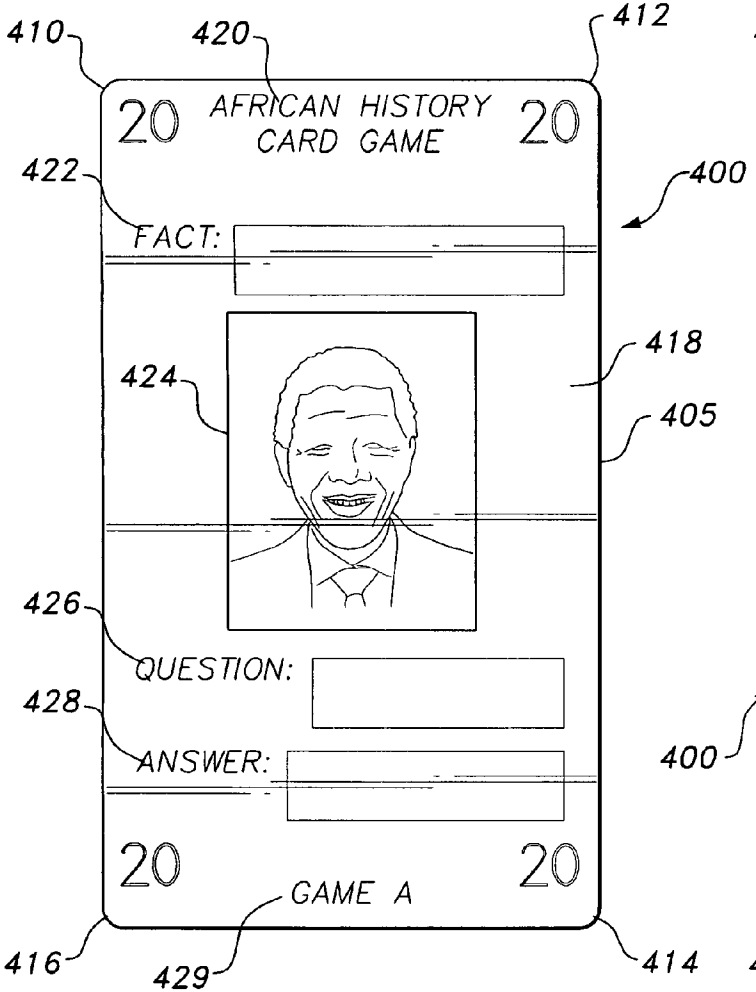
FIG. 4A is a front view of an exemplary card with a numerical value of twenty points from the African history card game according to the present invention.

With respect to FIG. 4A, a card 400 having a front face 405 with a numerical value of twenty points is shown. The African history card deck 100 includes a plurality (e.g., four, or more or fewer) of twenty point value cards 400 with the points indicated in each of the four corners 410, 412, 414, and 416. Thus, each ascending level of difficulty has a point value twice that of the previous level, e.g., increasing from five to ten points, and then increasing from ten to twenty points. The card 400 has a white (or alternatively, some other color) background 418, and all the information, both alphabetic and numeric, are displayed in a contrasting color on the front face 405 to facilitate reading the card 400.

At the top 420 of the card 400 is the title of the card game, i.e., African History Card Game. Next is a fact 422 that is the theme of the card 400, e.g., "Africa was colonized by Europeans and forced to live under an oppressive system called Apartheid." On this card 400, the theme is prominent people. On some of the other twenty point cards, the themes may cover history, inventions, science, sports, religion, culture, civil rights, agriculture, language, and music, and perhaps other themes.

A picture 424, shown below the fact 422, reiterates the theme of the card 400. Below the picture 424 is a question 426. The question 426 is directly focused on the theme of the card 400. On this card 400, the theme is prominent people, so the question 426 could be "who is the African who was jailed for objection to apartheid and become president of South Africa?" Below the question 426, is a series of answers 428 including the single correct answer 428*a* (shown on the back face 430 of the card 400, in FIG. 4B). Exemplary answers for the above question may be:

| | |
|---|---|
| 1. Desmond Tutu | 2. Nelson Mandela |
| 3. Idi Amin | 4. Jomo Kenyatta |

At the bottom 429 of the card is a rating system of the difficulty of the particular card game. In this case, the game is rated with an "A." As has been discussed before, there may be over fifty levels of the African history card game. The games are labeled "A" through "Z" and continue "AA" through "ZZ"" and so forth, with the educational difficulty increasing with every increased rating.

With reference now to FIG. 4B, a rear view or rear face 430 of the card 400 is shown. The rear face 430 contains three main colors: red 432, yellow 434, and green 436, forming a rectangular or hanging flag member 438 (which also forms a grid or matrix of rows and columns of alphabetic characters) with the red color 432 on top. These three colors make up the colors now found in the national flags of many African nations. The colors are surrounded with a white (or other color, as desired) border 440 so as to make the reading of the back of the card easy and less of strain on a player's eyes. Around the border 440 are four corners 442, 444, 446, and 448 with the number five prominently displayed in each of the corners 442, 444, 446, and 448 to indicate the point value of the card 400. Also, the indicia both alphabetic and numeric outside the hanging flag or alphabetic grid or matrix 438 may be printed in red (or other contrasting color) on this rear face 430 to facilitate the reading of the card 400, and to keep the color coordination. Other colors may be used as desired. Outlined on the rear face 430 throughout the colors red 432, yellow 434, and green 436 is an outline 450 of the continent of Africa. The outline 450 is in black. Thus, all four colors of the Pan-Africa nations are represented on the back of the cards for the card deck 100.

The rectangular or hanging flag 438 includes a letter grid with columns 452 and rows 454. There are preferably eleven columns and sixteen rows forming the rectangular black letter grid 438 over the colors red 432, yellow 434, and green 436, although more or fewer rows and columns may be used as desired. Most of the cells or squares 456 in the grid 438 include a letter from a random selection of letters A to Z, with some letters being repeated to scramble the letters throughout the grid 438. The scrambling makes the grid 438 appear to be made up of random letters. However, the correct one of the answers 428 for the question 426 on the front face 405 of the card 400 can be found unscrambled in the grid 438.

On the rear face 430 of this card 400, the correct answer 428*a* to the question 426 is found horizontally in row nine ("NELSON"), indicated specifically by the reference numeral 458, and in a descending left-to-right diagonal in columns three through nine, indicated respectively by reference numerals 460 and 362, and rows five through eleven indicated respectively by reference numerals 464 and 466 ("MANDELA"). Of course, an answer can be in a column, row, or even in a diagonal direction, as on this card 400 where the answer comprises two words or names in a horizontal row and in a diagonal direction. However, while the correct answer 428*a* is hidden in the letter grid 438, it is unscrambled, and it should be noted that only one correct answer 428*a* is on the rear face 430 of card 400.

Figure 5:
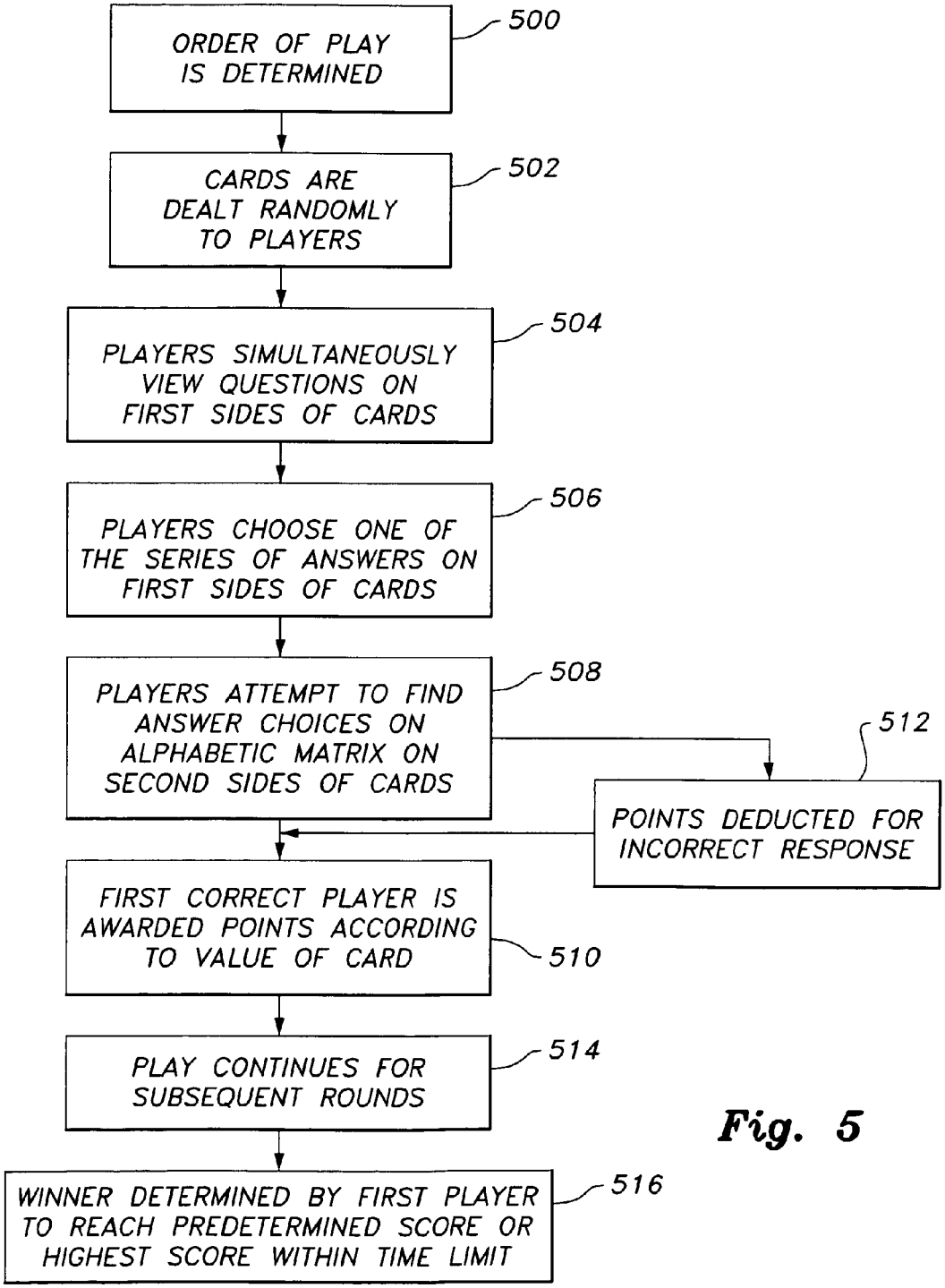
FIG. 5 is a flow chart illustrating the basic steps in the method of play of the game.

FIG. 5 provides a flow chart showing the basic steps in the method of play of the African history card game. Initially, the players must determine the order of play, as in most such games where play is accomplished by dealing cards. This is indicated generally by the first step 500 of FIG. 5. This may be accomplished in any conventional manner, but one means of doing so using the cards 100 of the game is to deal the cards in sequence to the players, with the first player receiving a card of highest value being designated as the leading or first dealer. The deal passes to other players in subsequent rounds in an order determined by the players, e.g., clockwise, etc. A judge, or non-playing participant, is also selected from the participants at about this point. The maximum number of players may be equal to the number of cards in the deck 100, e.g., fifty, as each player receives only a single card per deal or round of play.

The player chosen as the first or lead dealer then deals one card randomly to each of the players, with the first face or side (i.e., the side with the picture, questions, and answer choices) face down so as to be concealed from the players. This is indicated generally by the second step 502 of the flow chart of FIG. 5. As the obverse second sides of the cards are visible, the players can see the alphabetic matrix and the point value of each card, and thus have some idea as to the difficulty or complexity of the question that they must answer. However, the alphabetic matrix conceals the correct answer sufficiently that a player is not likely to discern the correct answer merely by observation of the matrix or grid. Rather, a player must have at least some knowledge of the subject area, and does not know the specific question asked of him or her until seeing the first face of the card. A player who "peeks" at the first side of his or her card before permission is granted by the judge, loses points equal to the point value of his or her card.

At this point the judge announces or signals to all players simultaneously that they may turn their cards over to observe the front or first sides thereof, generally as indicated by the third step 504 of FIG. 5. The players are then able to read the questions on their cards and select what they feel to be the correct response or answer from the choices available, as indicated by the fourth step 506 of FIG. 5. When a player has accomplished this, the player again turns the card over so the second face with the alphabetic grid or matrix is face up and searches for the correct answer in the grid or matrix, generally as indicated by the fifth step 508 in the flow chart of FIG. 5.

The first player to find the correct answer announces this to the other players and judge, whereupon play is suspended. In the event that two or more players announce their finding of the correct answer on their respective cards at nearly the same time, the judge will make a determination as to which player was first. All other players turn in their cards to a central location, or to the judge or to the next player scheduled to deal for the next round of play. Assuming the first announcing player is correct, the judge awards that player with points equal to the value shown on that player's card, e.g., five, ten, or twenty points, generally as indicated by the sixth step 510 of FIG. 5. An incorrect answer results in that player losing points equal to the value on his or her card, generally as indicated by the seventh step 512 of the flow chart of FIG. 5.

Play continues as described above with the next player assigned as the dealer dealing the cards randomly to the players, generally as indicated by the eighth step 514 of the flow chart of FIG. 5. It is generally expected that a complete game will include several hands or rounds of play, as no more than twenty points (or whatever the maximum point value of any of the cards may be) may be accrued in any round of play, and a complete game will likely require many times that number of points. The end of the game may be determined in any of several different ways. The primary means of determining the end of the game is by setting a predetermine point total or score, which one player must reach to win the game. The predetermine point total is arbitrary and may be set as desired, e.g., four hundred points, requiring at least twenty hands or rounds of play, and likely more. Alternatively, the end of the game may be determined by the elapsing of a predetermined period of time, e.g., an hour, or other time period as desired. The game may be played during a break, lunch hour, or other limited period of time, with the end of the limited period determining the end of the game and the player having the highest score being the winner. These alternatives are indicated in the ninth and final step 516 of the flow chart of FIG. 5.

Accordingly, the African history card game provides a versatile and entertaining means of educating people about African history, culture, personalities, technology, and other aspects of the continent of Africa and its people. While the game is directed to the African continent and its people, it will be noted that the concept of cards each having a question and a series of answers on one face and containing the correct answer in an alphabetic matrix on the opposite face, and the rules of play described herein, may be expanded to cover other nations, cultures, and subject areas as well. For example, the game may be used to provide instruction about another part of the world or ethnic group, if so desired. Alternatively, the game may be directed to a particular academic or vocational subject matter, if so desired. Moreover, it will be seen that the alphabetic matrix on the back sides of the cards need not be limited to the Roman alphabet, but may comprise any of a number of different alphabets as desired. Accordingly, the game will find widespread interest among a wide variety of different ethnic, professional, and other groups, depending upon the specific subject area to which any given game is directed.

It is to be understood that the present invention is not limited to the embodiments described above, but encompasses any and all embodiments within the scope of the following claims.

I claim:

1. An African history card game, comprising a deck of cards, each of the cards having:

a front face with a theme-related fact, a theme-related picture, a theme-related question, and a plurality of multiple choice answers displayed thereon, the plurality of multiple choice answers containing a single correct answer therein;

a rear face having a plurality of rows, a plurality of columns, and a plurality of diagonals defining a matrix of cells, each of the cells containing an alphabetic character; and the single correct answer being contained within at least one of the rows, columns, and diagonals of the matrix of the rear face of the card.

2. The African history card game according to claim 1, wherein the single correct answer comprises a plurality of words, each of the words being contained in a separate one of the rows, columns, and diagonals of the matrix.

3. The African history card game according to claim 1, wherein each of the cards has a point value displayed on both the front face and the rear face thereof, the point value being based on the difficulty of the question on the particular card.

4. The African history card game according to claim 3, wherein:

the cards comprise a first card group, a second card group, and a third card group;

the cards of the third card group each have a point value twice that of the cards of the second card group; and the cards of the second card group each have a point value twice that of the cards of the first card group.

* * * * *